United States Patent [19]

Herr et al.

[11] Patent Number: 4,791,682

[45] Date of Patent: Dec. 20, 1988

[54] GLOVE FOR ATTACHMENT TO SELF-SERVICE FUEL PUMP

[76] Inventors: Thomas E. Herr, 11595 Hemlock, Overland Park, Kans. 66210; Susan H. McCormick, 18101 Dearborn, Stillwell, Kans. 66085

[21] Appl. No.: 54,942

[22] Filed: May 27, 1987

[51] Int. Cl.[4] ..... A41D 19/00

[52] U.S. Cl. ..... 2/160; 2/159; 2/168

[58] Field of Search ..... 2/160, 161 R, 159, 158, 2/168, 167

[56] References Cited

U.S. PATENT DOCUMENTS

| | | | |
|---|---|---|---|
| 1,468,791 | 9/1923 | Abraham et al. . | |
| 2,022,910 | 12/1935 | Hanley | 2/159 X |
| 2,304,137 | 12/1942 | Peakes . | |
| 2,493,977 | 1/1950 | Kochman | 2/160 X |
| 2,710,409 | 6/1955 | Burandt | 2/160 |
| 4,240,157 | 12/1980 | Peters | 2/168 X |
| 4,670,909 | 6/1987 | Forrester | 2/160 |

*Primary Examiner*—Louis K. Rimrodt
*Assistant Examiner*—J. L. Olds
*Attorney, Agent, or Firm*—Emrich & Dithmar

[57] ABSTRACT

A glove is provided with a grommet in which is secured one end of a flexible electrically insulating cord, the other end of which is secured to a plastic clamp to be clamped about the dispensing hose or nozzle of a gasoline pump for use in the self-service dispensing of gasoline. The glove has an outer body of water-proof, gasoline-resistant and wear-resistant material and an inner liner of fabric material, between which may be disposed from one to three layers of thermally insulating material, depending upon the climate in which the glove is to be used. The glove is designed for use on either a right or left hand, and the cord attachment may be at either the wrist end or the finger end of the glove.

20 Claims, 2 Drawing Sheets

FIG. 4
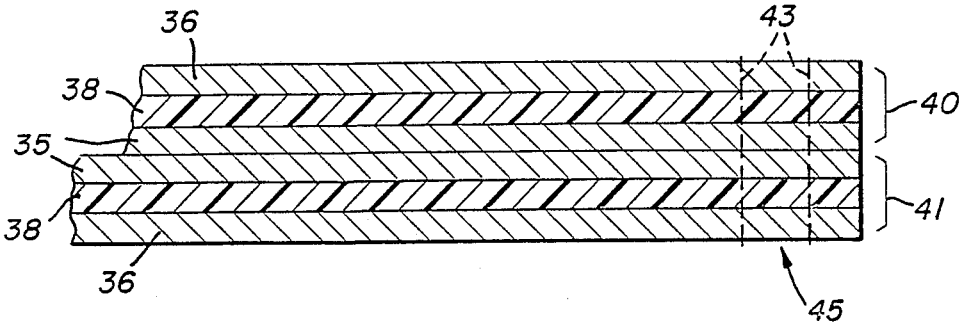
FIG. 5
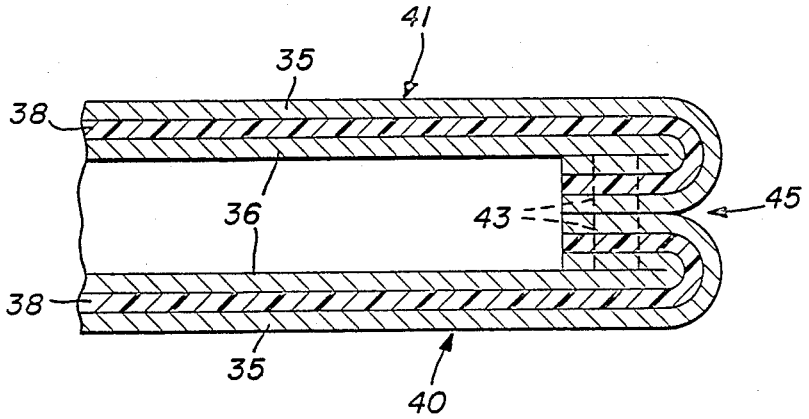
FIG. 9
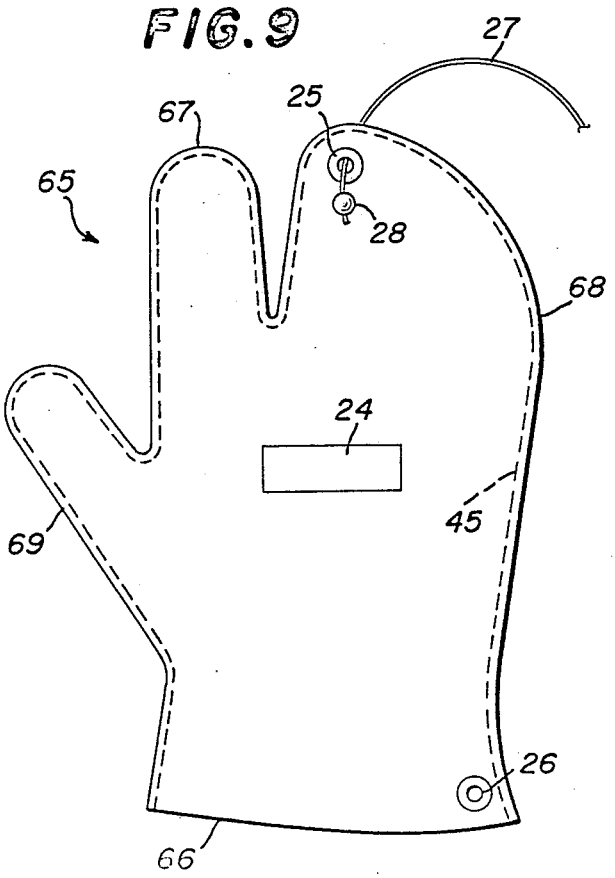
FIG. 6
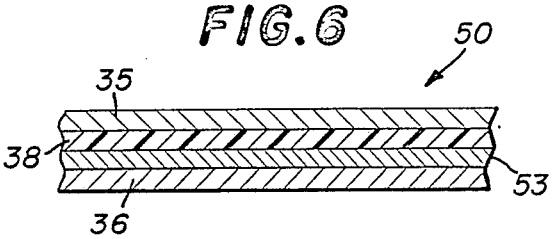
FIG. 7
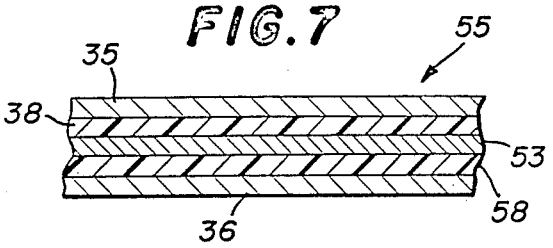
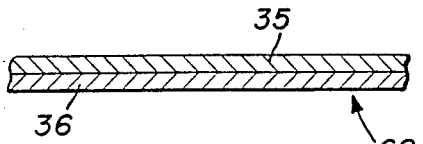
FIG. 8

GLOVE FOR ATTACHMENT TO SELF-SERVICE FUEL PUMP

BACKGROUND OF THE INVENTION

The present invention relates to protective gloves and, in particular, to gloves for use during the self-service dispensing of fuel into a vehicle tank. In the dispensing of gasoline or other vehicle fuel, it is common for the fuel to be splashed or spilled onto the pump-manipulating hand of the person dispensing the fuel. This can be damaging to the skin of the hand and also leaves an offensive odor, which can remain on the skin for a long time and is frequently difficult to wash off. Furthermore, the presence of gasoline and the attendant fumes and vapors on a person's hand can be hazardous if the person is a smoker.

These problems are particularly aggravated in the case of self-service gasoline stations, which are becoming more and more prevalent. Many self-service gasoline stations do not provide cleaning materials for customers to clean their hands. Thus, the odors and fumes attendant to gasoline on the hands can remain with the customer and in his vehicle for a considerable period of time.

Furthermore, in cold weather handling of the metal dispensing nozzle can be very uncomfortable. While, in cold weather the user may have a pair of gloves or mittens with him which will provide some thermal insulation from the cold dispensing nozzle, this does not alleviate and, indeed, can aggravate the gasoline spillage problem. If gasoline is spilled on the customer's glove, it is absorbed by the glove. Thus, the attendant odors will remain on the glove for very long periods of time and may damage or ruin the glove. If the customer carries a special glove in his vehicle for use in dispensing gasoline, the odors from the glove may permeate the vehicle. Furthermore, the glove with gasoline absorbed therein constitutes a continuous safety hazard.

It is known to provide special protective gloves designed to repel or be resistant to certain chemical substances. While such a specialized protective glove could be carried in a user's vehicle, it would still have the problem of retaining gasoline odors for long periods of time.

In U.S. Pat. No. 4,240,157, there is disclosed a self-service gasoline glove which is adapted to be fastened to a part of the vehicle, such as the rear of the license plate or the inside of the compartment door containing the gasoline filler tube. While such an arrangement might tend to minimize the odors in the vehicle, it still requires the customer to purchase a specialized glove. Furthermore, storage of the glove on the outside of the vehicle may expose it to the elements and dirt and grime from the road.

SUMMARY OF THE INVENTION

It is a general object of the present invention to provide an improved gasoline dispensing glove which avoids the disadvantages of prior gloves while affording additional structural and operating advantages.

An important feature of the invention is to provide a gasoline dispensing glove which is available for use by a customer in a self-service gasoline station, but which does not have to be purchased by the customer or carried by the customer in his vehicle.

Another feature of the invention is the provision of a glove of the type set forth which is readily available to the user at the gasoline pump.

Yet another feature of the invention is the provision of a glove of the type set forth which provides thermal insulation which can be tailored to the local climate.

It is another feature of the invention to provide a glove of the type set forth which does not absorb gasoline.

These and other features of the invention are attained by providing a glove for self-service dispensing of gasoline from an associated pump having a dispensing hose and nozzle, the glove comprising: an outer glove body of waterproof, gasoline resistant and wear resistant material; an inner liner of fabric material disposed within the glove body and fixedly secured thereto; and coupling means for securing the glove body to the associated pump hose or nozzle, the coupling means including an elongated, flexible, electrically insulating member secured at one end thereof to the glove body, and electrically insulating attachment means secured to the elongated member at the other end thereof and adapted to be secured to the associated hose or nozzle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 4 is a further enlarged, fragmentary, sectional view of the material of the glove of FIG. 2, illustrated during the stitching together of two sides of the glove;

FIG. 5 is an enlarged, fragmentary, sectional view taken along the line 5—5 in FIG. 2;

FIG. 6 is a fragmentary sectional view of an alternative form of material for use in the glove of FIG. 2;

FIG. 7 is a view similar to FIG. 6, illustrating yet another form of material for use in the glove of FIG. 2;

FIG. 8 is a view similar to FIGS. 6 and 7, illustrating yet another form of material for use in the glove of FIG. 2; and FIG. 9 is a view similar to FIG. 2, illustrating another embodiment of the glove of the present invention.

DESCRIPTION OF THE PREFERRED EMBODIMENTS

Figure 1:
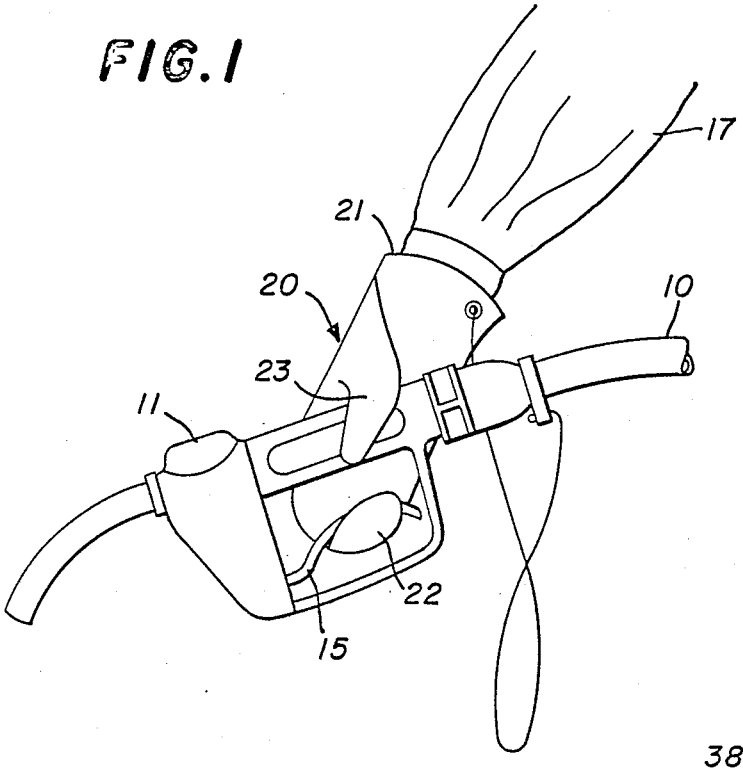
FIG. 1 is a fragmentary side elevational view of the glove of the present invention being used in dispensing fuel from a fuel pump dispensing nozzle.
Figure 2:
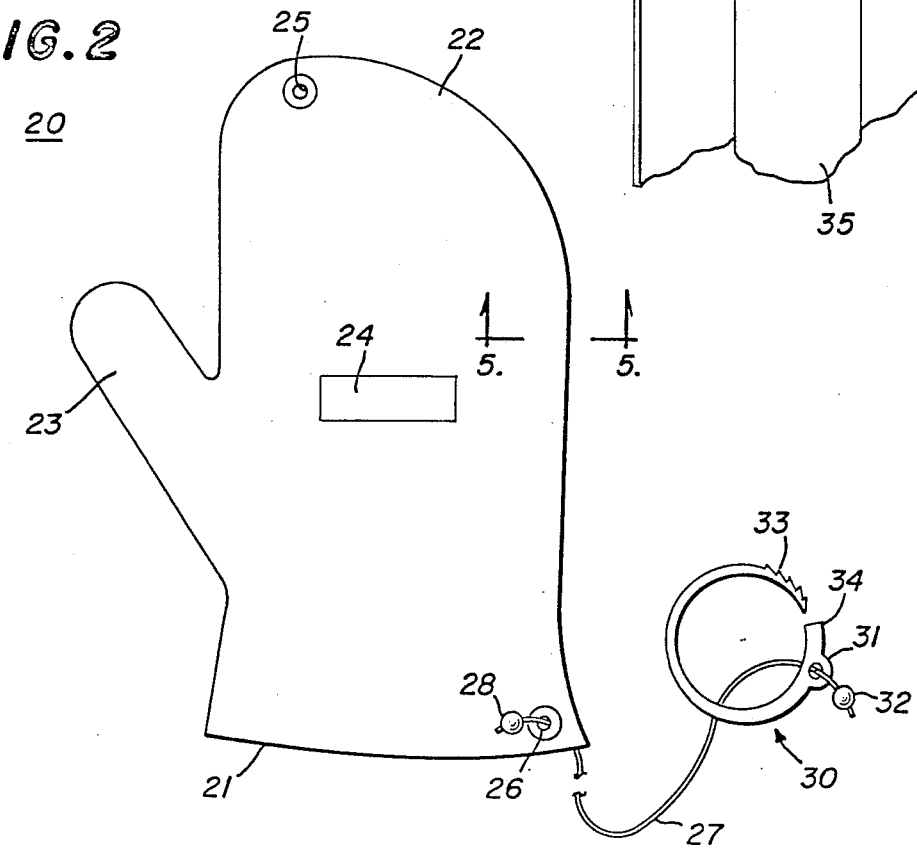
FIG. 2 is an enlarged, front elevational view of a glove constructed in accordance with and embodying the features of a first embodiment of the present invention.

Referring to FIGS. 1 and 2 of the drawings, there is illustrated a glove, generally designated by the numeral 20, constructed in accordance with and embodying the features of a first embodiment of the present invention. The glove 20 is designed for use by a customer in the self-service dispensing of gasoline or other vehicle fuels. In FIG. 1, there is illustrated a typical customer's arm 17 with a hand inserted into the glove 20 and used in a typical dispensing operation. More particularly, the fuel pump has a dispensing hose 10 with a dispensing nozzle 11 fixed thereto at the distal end thereof in a known manner. The nozzle 11 has a valve lever 15 which is grasped by the fingers of the customer while his thumb is hooked over the top of the nozzle, as illustrated. While FIG. 1 illustrates the glove 20 being used by a right-handed customer, it will be appreciated that the glove 20 is designed for use by either right-handed or left-handed customers.

The glove 20 is in the form of a mitten having an open or wrist end 21 into which the hand of the customer is inserted, a large finger portion 22, defining a compartment accommodating the fingers of the customer, and a thumb portion 23 defining a compartment for accommodating the customer's thumb. Preferably, a logo patch 24 may be located on the palm portion of the glove 20 for displaying the logo of the fuel company. This could be in the form of a separate patch to be applied to the glove or could be imprinted on the glove material. While only one side of the glove 20 is illustrated in FIG. 2, it will be appreciated that the logo patch 24 could be provided on both sides of the glove.

The glove 20 is provided with two grommets or ferrules 25 and 26 therethrough, respectively disposed at the tip of the finger portion 22 and adjacent to the wrist end 21 of the glove. There is also provided an elongated, flexible cord, or rope 27, formed of a suitable electrically insulating material, such as nylon, to avoid electrical sparks or shocks. The cord 27 is adapted to be extended through either one of the grommets 25 or 26, and then knotted, as at 28, to prevent accidental removal. The other end of the cord 27 is adapted to be coupled to a clamp 30. In particular, the clamp 30 is preferably formed of an electrically insulating material, such a nylon or other suitable plastic, and is in the form of a flexible open ring, having an eyelet 31 through which the other end of the cord 27 is received, the cord 27 then being knotted, as at 32, to prevent accidental removal from the clamp 30. The clamp 30 is provided with a pointed male end 33, which is preferably provided with external locking teeth, and a hollow female end 34, which is preferably also provided with internal teeth or detents (not shown). In use, the flexible clamp 30 is fitted around the hose 10 or the nozzle 11 and then locked in place by inserting the male end 33 into the female end 34, thereby affording a ratcheting engagement of the two rows of teeth. It will be appreciated that, if desired, other types of clamping means could be utilized, as long as it is formed of an electrically insulating material.

In use, the cord 27 may be of any desired length, but is typically of a length long enough to permit easy insertion of the customer's hand into the glove 20 and easy grasping of the nozzle 11, and yet short enough so that the glove 20 does not touch the ground when the nozzle 11 is replaced in the receptacle on the pump housing after use. A cord length of about 18 inches is suitable. While the cord 27 is shown attached to the grommet 26 at the wrist end of the glove 20 in FIG. 2, it will be appreciated that it could also be connected to the grommet 25 at the finger end of the glove 20 (see FIG. 6). In this latter case, the glove 20 would hang with the open end down when not in use, so as to prevent rain water or the like from entering the glove 20 if the fuel pump is in an unprotected area.

It is a significant feature of the invention that, by permanent attachment of the glove 20 to the hose 10 by means of the clamp 30, the glove 20 is always available for use by each customer, and the customer does not have to be responsible for providing his own glove. If the glove 20 becomes worn or otherwise unserviceable, or if it is desired to replace it with a different weight glove, as will be explained more fully below, replacement can be easily accomplished by simply detaching the cord 27 at the glove 20.

Figure 3:
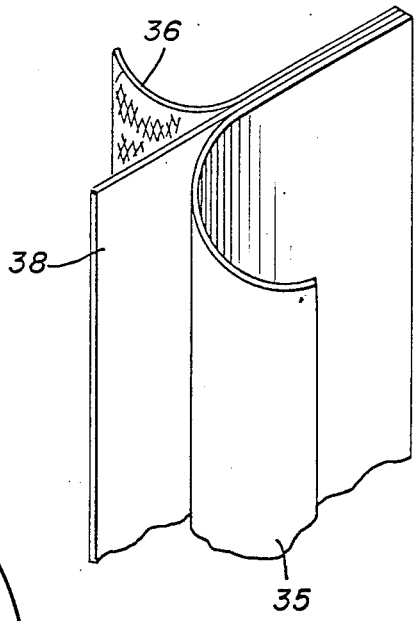
FIG. 3 is a fragmentary perspective view of the material used in the glove of FIG. 2.

It is another feature of the invention that the glove can be provided in a number of different weight for use in different climates. The glove illustrated in FIG. 2 is an intermediate weight glove and has a three-ply construction. Referring also to FIGS. 3–5, the glove 20 includes a outer body 35 formed of a wear-resistant material, such as canvas or duck cloth, which is treated with a suitable liquid-impermeable resin treatment, such as that sold by 3M Company under the trademark SCOTCHGARD, so as to render the body 35 substantially impervious to water and gasoline, and to prevent absorption of those fluids by the body 35. Alternatively, the outer body 35 could be formed of an inherently liquid-impermeable material such as vinyl. The glove 20 is also provided with an inner liner 36, which is preferably formed of a cotton flannel fabric to provide a soft lining for comfortable contact with the customer's hand. Disposed between the inner liner 36 and the outer body 35 is an intermediate body 38 of thermally insulating material, such as a woven polyester fiber fill material. Such material can be provided in different weights to provide different amounts of thermal insulation, depending upon the prevailing climate where the glove 20 is to be used.

As indicated above, the glove 20 is designed to be bilaterally symmetrical, so that it can be used equally well by right-handed or left-handed persons. Thus, preferably the glove 20 is comprised of two congruent forms 40 and 41 (see FIGS. 4 and 5), arranged as mirror images of each other, with each form being cut from a three-ply panel 39 comprising the outer body 35, intermediate body 38 and inner line 36. In fabrication of the glove 20, the two forms 40 and 41 are laid in congruent back-to-back relationship, with the outer bodies 35 in contact with each other, as illustrated in FIG. 4. Then the two forms 40 and 41 are sewn together with one or two lines of stitching 43 around the entire outer perimeter of the forms, except for the wrist end 21, to define a continuous seam 45. The glove is then turned inside out so that the outer body 35 is on the outside and the seam 45 is inside the glove 20, as illustrated in FIG. 5. The grommets 25 and 26 are then inserted in the glove 20 with suitable punching apparatus in a known manner. If the logo patch 24 is a separate body, it may be applied to the forms 40 and 41 either before or after the stitching operation.

Referring to FIG. 6, the glove 20 may also be formed of a heavy weight material, which is in the form of a four-ply panel 50. The panel 50 is substantially the same as the panel 39, except that there is an additional body of thermal insulating material 53 disposed between the inner liner 36 and the intermediate body 38. Preferably, the body 53 is a woven material of high thermal insulation characteristics, such as that sold by the 3M Company under the trademark "THINSULATE".

In extremely cold climates, an extra heavy weight material may be used in the form of a five-ply panel 55, illustrated in FIG. 7. The panel 55 is similar to the panel 50, except that it includes an additional body 58 of thermal insulating material disposed between the insulating body 53 and the inner layer 36. Preferably, the body 58 is of the same material as the body 38.

It will be appreciated that all of the insulating bodies 38, 53 and 58 also serve a secondary function of providing padding for the glove 20. In very warm climates a lightweight material may be utilized in the form of a two-ply panel 60, illustrated in FIG. 8, which includes only the outer body 35 and the inner liner 36.

Referring to FIG. 9, there is illustrated an alternative form of the glove of the present invention, generally designated by the numeral 65. The glove 65 is in the form of a modified mitten having an open wrist end 66, a closed index finger portion 67 providing a compartment for the customer's index finger, an enlarged finger portion 68 providing a compartment for accommodating the others of the customer's fingers and a thumb portion 69 defining a compartment for accommodating the customer's thumb. In all other constructional details, the glove 65 is identical to the glvoe 20, and may be formed of any of the various weights of material described above.

If desired, the outer body 35 may be provided in a bright color, such as day-glow orange, for high visibility. Preferably, the glove 20 or 65 will be provided in a single size large enough to fit the hands of all customers, although it will be appreciated that different sizes could be provided, if desired. It will also be appreciated that, in areas where the temperature changes significantly from season to season, the fuel station operator may maintain an inventory of several different weights of the glove 20 or 65, and use different weight gloves in different seasons.

From the foregoing, it can been seen that there has been provided an improved gasoline dispensing glove which is of simple and economical construction, is specifically adapted for attachment to the fuel dispensing hose or nozzle for use by all customers, and is designed to provide thermal insulation as well as protection from gasoline spillage.

We claim:

1. A glove for self-service dispensing of gasoline from an associated pump having a dispensing hose and nozzle, said glove comprising: an outer glove body of waterproof, gasoline resistant and wear resistant material; an inner liner of fabric material disposed within said glove body and fixedly secured thereto; and coupling means for securing said glove body to the associated pump hose or nozzle, said coupling means including an elongated, flexible, electrically insulating member secured at one end thereof to the glove body, and electrically insulating attachment means secured to said elongated member at the other end thereof and adapted to be secured to the associated hose or nozzle.

2. The glove of claim 1, wherein said outer glove body includes a sheet of canvas material treated with a water-impervious and gasoline-impervious material.

3. The glove of claim 1, wherein said inner liner includes a cotton flannel material.

4. The glove of claim 1, wherein said inner liner is sewn to said outer glove body.

5. The glove of claim 1, wherein said coupling means includes a grommet mounted on said glove and defining an aperture therethrough, said elongated flexible member comprising a cord extending through said grommet and knotted to prevent accidental detachment from said glove.

6. The glove of claim 5, wherein said grommet is disposed adjacent to the open or wrist end of the glove.

7. The glove of claim 5, wherein said grommet is disposed adjacent to the closed or finger end of the glove.

8. The glove of claim 1, wherein said electrically insulating attachment means includes a plastic clamping member adapted to be clamped around the associated hose or nozzle.

9. The glove of claim 1, wherein the glove is in the form of a mitten having a single finger compartment accommodating all four fingers and a thumb compartment.

10. The glove of claim 1, wherein said glove is in the form of a mitten having a first finger compartment accommodating the index finger and a second finger compartment accommodating the other three fingers and a thumb compartment.

11. A glove for self-service dispensing of gasoline from an associated pump having a dispensing hose and nozzle, said glove comprising: an outer glove body of waterproof, gasoline resistant and wear resistant material; an inner liner of fabric material disposed within said glove body; an intermediate body of padding and thermally insulating material disposed between said inner liner and said outer glove body; means fixedly securing together said outer glove body and said intermediate body and said inner liner; and electrically insulating coupling means for securing said glove body to the associated pump hose or nozzle.

12. The glove of claim 11, wherein said outer glove body and said intermediate body and said inner liner are sewn together.

13. The glove of claim 11, wherein said intermediate body is formed of a polyester material.

14. The glove of claim 11, and further comprising an insulating body of thermally insulating material disposed between said intermediate body and said inner liner and fixedly secured to each.

15. The glove of claim 14, and further comprising a second intermediate body of padding and thermally insulating material disposed between said insulating body and said inner liner and fixedly secured to each.

16. The glove of claim 15, wherein both of said intermediate bodies of padding and thermally insulating material are formed of the same material.

17. A glove for self-service dispensing of gasoline from an associated pump having a dispensing hose and nozzle, said glove comprising: an outer glove body of waterproof, gasoline resistant and wear resistant material; an inner liner of fabric material disposed within said glove body; an intermediate body of padding and thermally insulating material disposed between said inner liner and said outer glove body; means fixedly securing together said outer glove body and said intermediate body and said inner liner; and coupling means for securing said glove body to the associated pump hose or nozzle, said coupling means including an elongated, flexible, electrically insulating member secured at one end thereof to the glove body, and electrically insulating attachment means secured to said elongated member at the other end thereof and adapted to be secured to the associated hose or nozzle.

18. The glove of claim 17, wherein said coupling means includes a grommet secured to said glove and defining an aperture therethrough, said attachment means comprises a plastic clamp adapted to be clamped around the associated hose or nozzle, and said flexible member comprises an elongated cord adapted to have one end thereof received through said grommet and the other end thereof received through a complementary opening in said clamp, with each of said ends being knotted to prevent accidental removal from said glove and said clamp.

19. The glove of claim 17, and further comprising an insulating layer of thermally insulating material disposed between said intermediate body and said inner liner and fixedly secured to each.

20. The glove of claim 19, and further comprising a second body of padding and thermally insulating material disposed between said insulating body and said inner liner and fixedly secured to each.

* * * * *